United States Patent [19]

Winkler, Jr.

[11] Patent Number: 4,718,562

[45] Date of Patent: Jan. 12, 1988

[54] VERTICAL PACKAGE DISPLAY RACK

[75] Inventor: A. C. Winkler, Jr., Irving, Tex.

[73] Assignee: Standard Fixture Co., Inc., Dallas, Tex.

[21] Appl. No.: 941,706

[22] Filed: Dec. 15, 1986

[51] Int. Cl.[4] ..... A47F 5/08

[52] U.S. Cl. ..... 211/94.5; 211/87; 211/113; 223/87; 248/316.8

[58] Field of Search ..... 211/94.5, 94, 162, 87, 211/88, 113, 13, 118, 119; 223/85, 87; 206/292; 248/309.1, 316.8, 451

[56] References Cited

U.S. PATENT DOCUMENTS 1,276,845 8/1918 Wheary ..... 211/94.5

1,959,843 5/1934 Sprague ..... 248/451 X 4,467,926 8/1984 Percival ..... 211/94.5 X 4,509,648 4/1985 Govang et al. ..... 211/87 X

*Primary Examiner*—Ramon S. Britts

*Assistant Examiner*—Blair M. Johnson

*Attorney, Agent, or Firm*—Kanz, Scherback & Timmons

[57] ABSTRACT

Disclosed is a vertical display rack for packages. One or more mounting members are removably secured to a support structure. Each of the mounting members includes one or more arms extending from the support structure for supporting a plurality of the packages. The packages are each received in separate holders that are vertically suspended from the arms of the mounting members for display.

5 Claims, 7 Drawing Figures

VERTICAL PACKAGE DISPLAY RACK

This invention relates generally to package display apparatus. More particularly, it relates to apparatus for vertically displaying packaged goods.

Various arrangements have been used in the past for displaying packages in a store or the like. It is frequently desirable to display a large number or a large variety of packages in a manner which makes the packages accessible and attractively presented. This is a particular problem in clothing stores which stock numerous packages containing clothing (i.e. shirts, pants, sweaters, etc.). Typically, the clothing must be presented in a space as compact as possible, yet make a wide variety of sizes and patterns visible and available to potential purchasers.

Some conventional display racks include a cabinet with rows and columns of shelves. Each shelf receives a stack of packages and the potential purchaser must search through the stacks for packages to examine. However, this system is not entirely satisfactory in that many packages are obscured and may be overlooked, thus resulting in lost sales. Also, it is necessary for most businesses to conduct periodic reviews of inventories of merchandise which are unnecessarily difficult using existing display apparatus for packages such as herinabove described. Finally, it is desirable that a display system enable the packages to be loaded onto or removed from the apparatus as quickly and easily as possible. Conventional display rack apparatus fail to completely satisfy all of these requirements.

The present invention provides an improved display rack for packages which includes an individual holder for each package. Each holder comprises a rigid package supporting frame and means for securing a package to the frame. The holder supporting the package is vertically suspended from an arm projecting from a mounting member attached to a support structure. The holders are each separately removable from the mounting members and support structure for examination. In one embodiment of the invention, the holder comprises a generally triangular frame with a bracket at each corner for securing a generally rectangular package to the holder. A pair of mounting flanges laterally extend from each of the upper corners of the frame for suspending the holder from a pair of laterally spaced parallel arms projecting from a mounting member. The mounting member is attached to a support structure by a lip projecting from the mounting member that engages a horizontal groove in the support structure. Since packages are contained individually in each holder, each package can be readily removed from the display rack without disturbing other packages. However, since each package is individulally supported vertically, minimum space is occupied while providing maximum visual exposure of the packaged goods. Furthermore, individual packages may be removed, replaced, re-arranged or otherwise handled or inventoried with maximum convenience.

So that the manner in which the features and advantages of the invention are obtained and can be understood in detail, a more particular description of the invention briefly summarized above is made with reference to the embodiments thereof which are illustrated in the accompanying drawings, which drawings form a part of the specification and in which like numerals depict like parts in the several views. It is noted, however, that the appended drawings illustrate only a preferred embodiment of the invention and are therefore not to be considered limiting of its scope, for the invention may admit to other equally effective embodiments.

Figure 1:
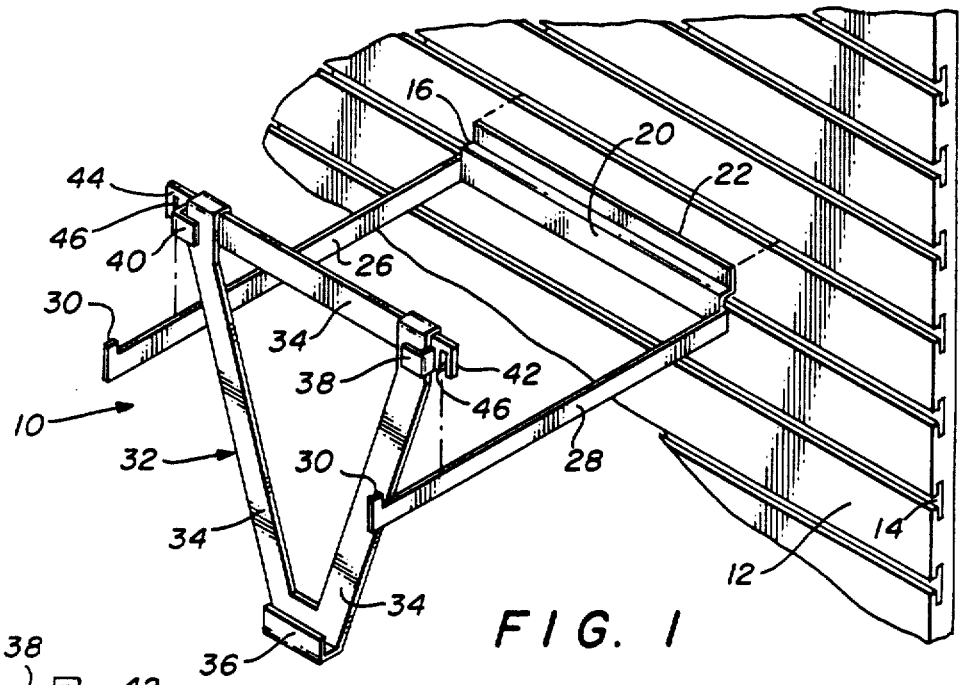
FIG. 1 is an exploded view of a vertical display rack according to the invention.

Referring now to FIG. 1 there is shown a display rack 10 including a support structure 12 which, in the illustrated embodiment, comprises a wall or the like. Of course, it is recognized that the support structure may comprise any structure, such as a free standing rack, having sufficient strength to support the packages as herein described. The support structure 12 forms a plurality of parallel, horizontal generally T-shaped grooves 14.

One or more mounting members 16 are provided, each including means for attachment to the support structure by engaging one of the grooves 14. In the illustrated embodiment, the mounting member 16 includes a back plate 20 and a generally L-shaped lip 22 extending laterally across the upper edge of the back plate. The mounting member is attached to the support structure by inserting the lip 22 upwardly into one of the grooves 14 at a desired location and placing the back plate in contact with the support structure below the groove. The mounting member may be easily moved by disengaging the lip from the groove and repeating the above procedure at a new position. A pair of arms 26 and 28 project from laterally spaced locations on the back plate 20 so that the arms are horizontal when the mounting member is loaded onto the support structure. Each of the arms terminates in an upwardly extending tang 30.

Alternative arrangements are possible for attaching the mounting member to the support structure. For instance, in place of the grooves 14, the support structure may include a plurality of perforations or holes, commonly referred to as a pegboard. The mounting members could be adapted for attachment to the support structure through an accommodating structure for insertion into and engagement with one or more of the perforations.

Figure 2:
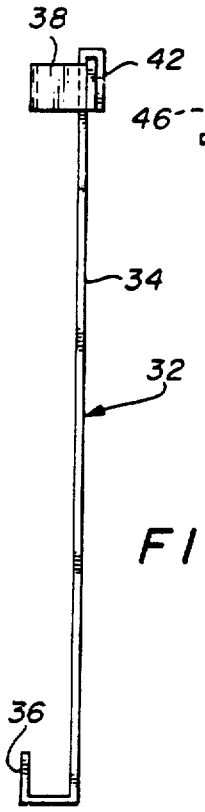
FIG. 2 is a side view of the holder of FIG. 1.
Figure 3:
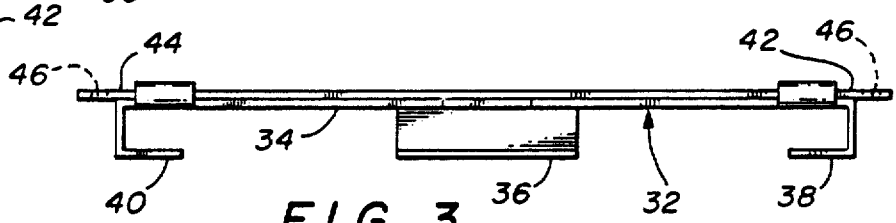
FIG. 3 is a top view of the holder of FIG. 1.

Holder 32, also shown in FIGS. 2 and 3, is adapted for placement on the mounting member between the arms 26 and 28. The holder is provided to vertically support a package (not shown in FIGS. 1–3). For the purposes of this invention, the term "package" includes any substantially rigid object having one or more defined edges about its perimeter. The holder 32 includes a rigid frame 34 which is illustrated as generally triangular and having an upper edge which is generally horizontal. Means are provided to secure a package to the print side of the frame. The securing means includes bracket 36 extending upwardly from the front side of the frame at the lowermost corner of the frame. This securing means also includes a pair of laterally spaced brackets 38 and 40 extend inwardly from the front side of the frame at the two upper corners of the frame. The brackets 36, 38 and 40 each define a groove adapted to receive and engage the edges of an object placed adjacent the front side of the frame. Of course, the number, size, spacing and location of the brackets may be altered as is found advantageous for a particular package. More specifically, any of the brackets of the securing means may be extended to accommodate the entire length of a side or bottom edge of the package. Further, one or more of the brackets may comprise a substantially flat surface extending substantially perpendicular to the frame without defining a groove to support and secure the package to the frame.

Although not shown, it is within the spirit and scope of this invention to provide means for securing a package to the frame that is adjustable for various sizes, shpes and thicknesses of packages. For instance, the brackets 36, 38 and 40 could be attached to the frame by fingers (not shown) slidingly engaged in sleeves (not shown) mounted on the frame. The location of the brackets could be individually adjusted relative to the frame and means provided to secure the brackets in the desired location, such as by screws or bolts threadedly mounted on the sleeves or frame adjacent the fingers. Likewise, means may be provided to independently vary the width of the grooves defined by each of the brackets to accomodate differing package thicknesses.

Figure 5:
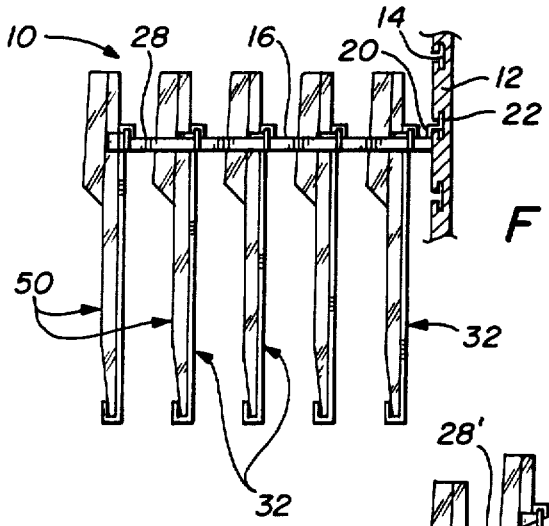
FIG. 5 is a side view of a portion of a display rack supporting a plurality of packages.

Means are provided to vertically suspend the holder from a mounting member. The suspending means includes a pair of flanges 42 and 44 extending outwardly from the upper corners of the frame and each defining a downwardly presented slot 46. The slots 46 are laterally spaced a distance equal to the lateral distance between the arms 26 and 28 of the mounting member. The holder may thus be vertically suspended from the mounting member by inserting the holder between the arms until each of the arms 26 and 28 are received in their respective aligned slots 46. A plurality of holders may be vertically suspended from the mounting member in a row extending from the support structure with the backsides of the holders facing the support structures, as is shown in FIG. 5. The holders are easily and quickly removed from the mounting members, rearranged or replaced separately from the remaining holders.

Figure 4:
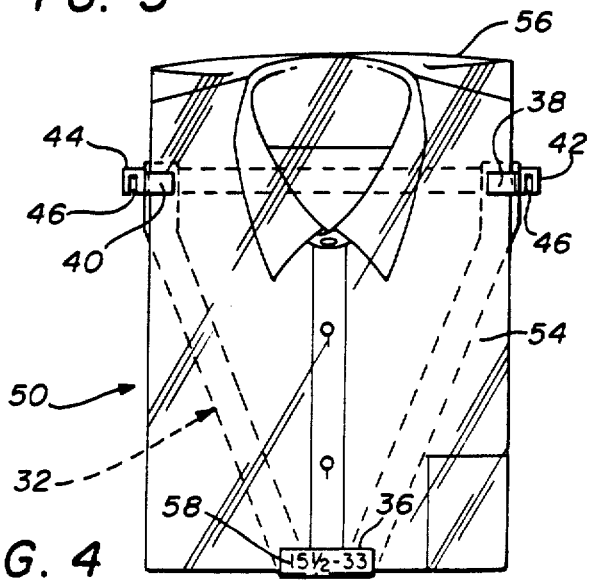
FIG. 4 is a front view of the holder of FIG. 1 supporting a package.

FIG. 4 illustrates a holder 32 receiving and supporting package 50. In the illustrated embodiment, the package is a generally rectangularly folded shirt 54 sealed in a flexible transparent bag 56. The lower edge of the package is received within the lowermost bracket 36 of the holder and each side edge is received within one of the brackets 38 and 40. It will be observed that the package may be easily loaded onto or removed from the holder and that the package is securely supported by the holder when suspended in a vertical position from the mounting member. In addition, indicia (such as at 58 on bracket 36) may be imprinted on the holder in one or more places indicative of the price, size, color or other characteristics of the package.

Figure 6:
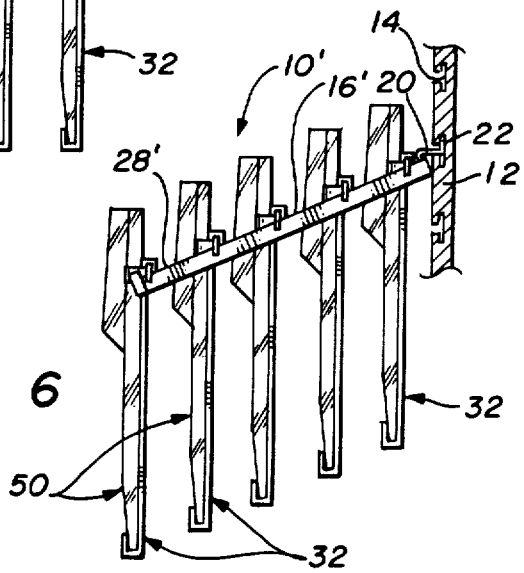
FIG. 6 is a side view of an alternate embodiment of the display rack of FIG. 1 supporting a plurality of packages.
Figure 7:
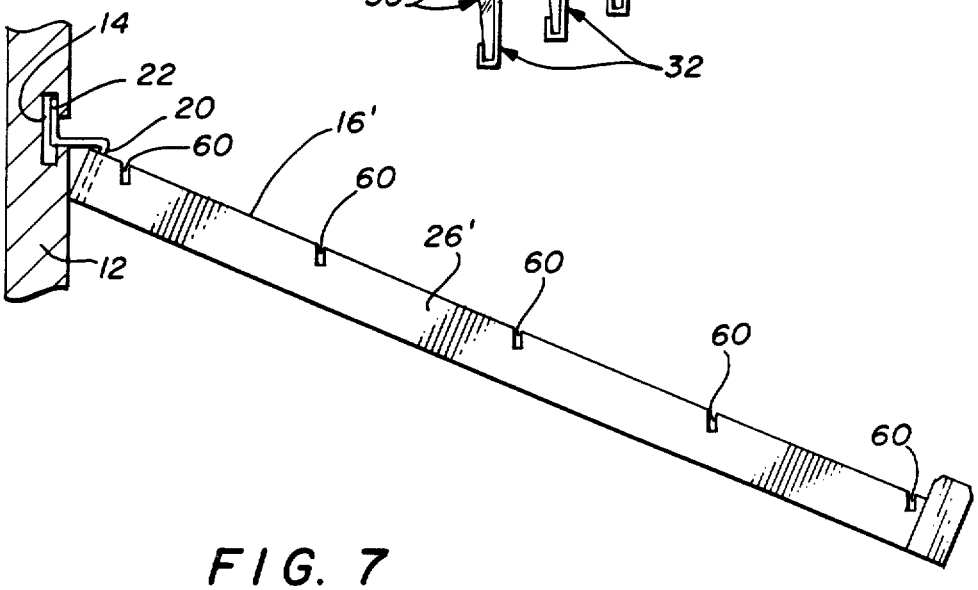
FIG. 7 is a side view of one of the mounting members of the display rack of FIG. 6.

An alternate embodiment 10' of the invention is shown in FIGS. 6 and 7 in which the arms 26' and 28' of each of the mounting members 16' are inclined downwardly from the back plate 20. A plurality of aligned pairs of generally upright notches 60 are formed in the upper edge of each arm. The notches 60 engage the slots 46 on a holder to space the holder from the other holders suspended from the mounting member and to prevent the holders from sliding forward toward the front end of the arms. This embodiment has the advantage of exposing more of the packages for viewing and selection than the embodiment shown in FIGS. 1–5 in which the holders are not secured in a predefined location on the arms and the number of holders is not limited.

Although the invention has been disclosed above, with regard to particular and preferred embodiments, these are advanced for illustrative purposes only, and are not intended to limit the scope of this invention. For instance, the shape of the package is not restricted to rectangular, and the mounting member and holders may be altered in size and shape to accommodate any desired size or shape of package. Further, the number and shape of the brackets on the various holders as well as the number of arms of the mounting member may be constructed as is found to be advantageous for a particular package. These variations remain within the invention as claimed below.

What is claimed:

1. Apparatus for displaying one or more generally rectangular packages comprising:

(a) a support structure;

(b) a mounting member including means for attaching the mounting member to said support structure, said mounting member including at least two substantially parallel package supporting arms projecting from said support structure; and (c) a holder for receiving a generally rectangular package, said holder including (i) a rigid package supporting frame having a front side, a back side and an upper edge, (ii) a flange extending laterally and downwardly from each end of said upper edge to engage said package supporting arms and suspend said holder from said upper edge in a vertical position with said front side facing away from said support structure, and (iii) at least one bracket extending from said front face of said rigid package supporting frame for engaging an edge of the generally rectangular package to secure said generally rectangular package to the front face of said rigid package supporting frame.

2. A vertical display rack for one or more packages comprising:

(a) a support structure having a horizontal groove;

(b) a mounting member having a package supporting arm and a lip for insertion into said groove to attach said mounting member to said support structure with said arm projecting from said support structure; and (c) a holder for supporting a package, said holder including (i) a package supporting frame having a front face, a back face and securing means extending from the front face of said package supporting frame for receiving one or more edges of the package so as to secure the package to the front face of said holder, and (ii) means extending from said package supporting frame for engaging said package supporting arm so as to vertically suspend said holder with the package from said package supporting arm of said mounting member.

3. The vertical display rack of claim 3 wherein said package supporting arm of said mounting member is inclined downwardly and outwardly from said support structure and defines at least one notch for engaging said means extending from said frame for engaging said arm of said holder so as to suspend said holder with a package from said mounting member at a predetermined location on said package supporting arm.

4. For use in a vertical display rack for one or more packages, a package holder comprising:

(a) a generally triangular package supporting frame having a lower corner; a front side, a back side and a substantially horizontal upper edge, said upper edge having opposing ends, each of which defines an opposite upper corner of said holders;

(b) a first bracket extending forwardly and upwardly from the lower corner of said generally triangular package supporting frame for receiving a lower edge of a package;

(c) a pair of second brackets extending forwardly and inwardly from said opposite upper corners, respectively, of said generally triangular package supporting frame for receiving opposing side edges of the package wherein said first and said pair of second brackets cooperatively secure the package to said generally triangular package supporting frame of said package holder; and (d) a pair of mounting flanges extending laterally from the ends of said upper edge at said opposite corners of said generally triangular package supporting frame thereby forming a slot between the ends of said upper edge and a respective flange to engage said vertical display rack and suspend said generally triangular package supporting frame in a vertical position.

5. Display apparatus comprising:

(a) vertical support structure;

(b) a mounting member including means for securing the mounting member to said vertical support structure, said mounting member including at least two substantially parallel arms projecting from said vertical support structure; and (c) a display receptacle adapted to receive and display a packaged article, said display receptacle comprising:

(i) a generally triangular package supporting frame having a front side, a back side and an upper edge, said upper edge being generally horizontal;

(ii) a first bracket extending upwardly from a lower corner of said generally triangular package supporting frame for receiving a lower edge of a packaged article;

(iii) a pair of second brackets extending inwardly from opposite upper corners of said generally triangular package supporting frame for receiving opposing side edges of the packaged article wherein said first and said pair of second brackets cooperatively secure the packaged article to said generally triangular package supporting frame of said display receptacle; and (iv) a pair of mounting flanges extending laterally from opposite upper corners of said generally triangular package supporting frame to engage said at least two substantially parallel arms and suspend said generally triangular package supporting frame in a vertical position.

* * * * *

UNITED STATES PATENT AND TRADEMARK OFFICE

CERTIFICATE OF CORRECTION

PATENT NO. : 4,718,562

DATED : January 12, 1988

INVENTOR(S) : A. C. Winkler, Jr.

It is certified that error appears in the above-identified patent and that said Letters Patent is hereby corrected as shown below:

Column 1, line 27, change "herina-" to ---hereina- ---
Column 2, line 64, change "print" to ---front---
Column 3, line 17, change "shpes" to ---shapes---
Column 4, line 66, change "3" to ---2---
Column 5, line 26, after "opposite" insert ---upper---

Signed and Sealed this

Seventh Day of June, 1988

*Attest:*

DONALD J. QUIGG

*Attesting Officer*

*Commissioner of Patents and Trademarks*